US005904612A

United States Patent [19]

Urakami

[11] Patent Number: 5,904,612

[45] Date of Patent: May 18, 1999

[54] SURFACE TREATING DEVICE

[76] Inventor: Fukashi Urakami, 608 Maruyoshi Bldg., 4-17-24, Konandai, Konan-ku, Yokohama-shi, Kanagawa 233, Japan

[21] Appl. No.: 08/836,006

[22] PCT Filed: Sep. 12, 1996

[86] PCT No.: PCT/JP96/02601

§ 371 Date: May 6, 1997

§ 102(e) Date: May 6, 1997

[87] PCT Pub. No.: WO97/10073

PCT Pub. Date: Mar. 20, 1997

[30] Foreign Application Priority Data

Sep. 13, 1995 [JP] Japan ..... 7-271677

[51] Int. Cl.[6] ..... B24C 3/06

[52] U.S. Cl. ..... 451/92; 451/351; 451/354; 451/36

[58] Field of Search ..... 451/36, 38–89, 451/92, 351, 354, 2, 3, 451, 455, 456, 80

[56] References Cited

U.S. PATENT DOCUMENTS

| | | | |
|---|---|---|---|
| 2,590,819 | 3/1952 | Huyett | 451/3 |
| 3,436,866 | 4/1969 | Nye | 451/3 |
| 3,550,321 | 12/1970 | Dye | 451/3 |
| 4,095,378 | 6/1978 | Urakami . | |
| 4,934,475 | 6/1990 | Urakami | 451/92 |
| 4,997,052 | 3/1991 | Urakami | 451/92 |
| 5,536,199 | 7/1996 | Urakami | 451/354 |

FOREIGN PATENT DOCUMENTS 60-26752 6/1985 Japan .

*Primary Examiner*—Robert A. Rose
*Assistant Examiner*—George Nguyen
*Attorney, Agent, or Firm*—Smith, Gambrell & Russell, LLP; Beveridge, DeGrandi, Weilacher & Young Intellectual Property Group

[57] ABSTRACT

A surface treating device includes a tubular blasting case member having a main open face and a sub-open face. A suction-adhering seal engages the blasting case to seal a space defined between the blasting case and the surface of the object being treated. Sand, water, or other abrasive material is ejected through a nozzle and the blasting case, toward the surface being treated. A flat belt or plate, which includes a nozzle opening, engages the sub-open face of the blasting case and covers the blasting case opening. A surface of the flat belt member is brought into sealing contact with a surface of the sub-open face due to a difference in pressure between an inside and an outside of a pressure reduction space such that the blasting case opening is completely covered and sealed while the flat belt member reciprocatingly moves along with the nozzle.

9 Claims, 5 Drawing Sheets

SURFACE TREATING DEVICE

TECHNICAL FIELD

This invention relates to a surface treating device capable of removing foreign matter, such as an old coating or rust, stuck onto the surface of an object, or of roughening the surface of an object, by ejecting a high pressure fluid such as water, or a high pressure fluid mixed with abrasives, toward the surface of the object.

The present invention also relates to a surface treating device capable of removing foreign matter, such as an old coating or rust, stuck onto the surface of an object, or of roughening the surface of an object, by ejecting a high pressure fluid such as water or a high pressure fluid mixed with abrasives, toward the surface of the object, while suction-adhering to the surface of the object by the pressure of an ambient fluid such as air or water and moving along the surface.

BACKGROUND ART

So far, ultrahigh pressure water jetting equipment and sand blasting equipment have been put to practical use as surface treating devices which eject a high pressure fluid such as water or a high pressure fluid mixed with abrasives, toward the surface of an object such as an oil storage tank or a ship hull, thereby removing foreign matter such as an old coating or rust, stuck onto the surface of the object, or roughening the surface of the object with the abrasives ejected, to make the surface ready for coating; or a device for cleaning the surface of the object to carry out non-destructive testing.

In Japanese Patent Publication No. 26752/1985 and the specification and drawings of U.S. Pat. No. 4,095,378, there is disclosed devices which can be exemplified as a surface treating device which ejects a high pressure fluid such as water or a high pressure fluid mixed with abrasives, toward the surface of an object while suction-adhering to the surface of the object by the pressure of an ambient fluid such as air or water and moving along the surface, thereby removing foreign matter, such as an old coating or rust, stuck onto the surface of the object, or roughening the surface of the object with the abrasives ejected, to make the surface ready for coating; or a device for cleaning the surface of the object to carry out non-destructive testing.

Such a device comprises a blasting case, wheels as moving means mounted on the blasting case, a suction-adhering seal connected to the blast case and having its free end portion adapted to make contact with a surface of the object, and a pressure reduction means for discharging a fluid from a pressure reduction space defined by the blasting case, the surface of the object and the suction-adhering seal.

When the pressure reduction means is energized in this device, the fluid within the pressure reduction space is discharged outside, and the pressure of the fluid acting on the blasting case of the device owing to the difference in fluid pressure between the inside and the outside of the pressure reduction space is transmitted to the surface of the object via the wheels, and the fluid pressure causes the device to suction-adhere to the surface.

When, in this suction-adhering state, the wheels are rotated by driving means such as an electric motor, the device moves along the surface of the device by the action of the wheels.

Further, such a device is provided with a working unit of an abrasives-blasting means such as a nozzle which ejects abrasives to the surface of the object.

In conventional abrasives-blasting equipment using compressed air, a mixed fluid which is composed of about 13 $m^3$/min. of compressed air pressurized to about 6 kg/$cm^2$ and about 35 kg/min. of non-steel abrasives is ejected from a nozzle with a diameter of about 15 mm, the nozzle is swung at a swing angle of from about 60 degrees to about 90 degrees to treat by abrasives about 400 mm in width on the surface of the object, and further, the swung nozzle is gradually moved in the direction which intersects at right angles with the swing direction along the surface of the object at a rate of about 1.8 m/min. Thus, the surface is treated continuously.

The conventional device described above, however, involves the following problems to be solved.

That is, in conventional abrasives air-blasting equipment using compressed air, the treated surface has unevenness in treatment that is caused by change of distance between the surface of the object and the tip of the nozzle depending on a swing angle of the nozzle. Further, it is difficult for the device to maintain a low height from the surface of the object because unevenness in treatment becomes greater when the swing angle is set to above 90 degrees for the purpose of obtaining a device with the lower height from the surface of the object.

Incidentally, a device whose height from the surface of the object is high is difficult to use in a narrow space.

Whereas, in conventional ultrahigh pressure water jetting equipment, about 20 liters/min. of water pressurized to an ultrahigh pressure of about 2,000 to about 2,500 kg/$cm^2$ is ejected from a nozzle with a diameter of 0.1 to 0.5 mm, and a nozzle with a revolution diameter of about 400 mm is revolved at a speed of about 1,000 rpm on a plane parallel to the surface apart from the surface of the object by 20 to 30 mm, the revolving nozzle being gradually moved along the surface of the object at a speed of about 3 m/min. Thus, the surface of the object is treated continuously.

Such a device has a swivel joint for connecting the nozzle and an ultrahigh pressure water hose which supplies the ultrahigh pressure water to the nozzle.

In conventional ultrahigh pressure water jetting equipment, a mixing nozzle in which abrasives are mixed into ultrahigh pressure water on the downstream side of the nozzle is provided as a means for mixing the abrasives into an ultrahigh pressure water stream because it is difficult to mix abrasives having a larger size than the diameter of the nozzle into the ultrahigh pressure water stream prior to ejecting the abrasives from the nozzle for the reason that the diameter of the orifice of the nozzle is too small for ejecting of the abrasives.

The conventional device described above, however, has the following problems to be solved.

That is, in conventional ultrahigh pressure water jetting equipment, it is difficult to mix abrasives into an ultrahigh pressure water stream to be ejected from a revolving nozzle. The reason is because it is difficult to produce such a swivel joint having two-phase flow for supplying separately the ultrahigh pressure water and the abrasives to the revolving nozzle.

Furthermore, the conventional device described above, however, has the following problems to be solved.

That is, in a conventional ultrahigh pressure water jetting equipment, because of the difficulty in mixing abrasives into an ultrahigh pressure water stream ejected from the revolving nozzle it is difficult to remove hard rust although soft coatings are easily peeled off.

Further, an anchor pattern, i.e., roughness, can not be formed on the surface of the object in the conventional ultrahigh pressure water jetting equipment because its formation absolutely requires that abrasives must be ejected toward and impinged on the surface of the object.

A main object of the present invention to overcome the technical problems is, therefore, to provide, in abrasives air-blasting equipment using compressed air or ultrahigh pressure water jetting equipment, a surface treating device which is capable of effectively treating the surface of the object without generating unevenness in treatment by allowing a nozzle to move, in parallel, along the surface of the object without using swivel joint as means for feeding a high pressure fluid or a high pressure fluid mixed with abrasives to the nozzle and which can be used in a narrow space owing to its reduced height.

Another object of the present invention is to provide, in a surface treating device capable of being suction-adhered to the surface of an object such as an oil storage tank or ship hull owing to the pressure of the ambient fluid such as the air or water and moving therealong, a surface treating device which is capable of effectively treating the surface of the object without generating unevenness in treatment by allowing a nozzle to move, in parallel, along the surface of the object without using a swivel joint as means for feeding a high pressure fluid or a high pressure fluid mixed with abrasives to the nozzle and can be used in a narrow space owing to its reduced height, and further in which old coatings or abrasive grains peeled off from the surface of the object are prevented from scattering to the outside of the device thereby to not contaminate the environment and which is safe because it can be operated by a remote-control mode.

DISCLOSURE OF THE INVENTION

To overcome the above main technical problems, an object of the present invention is to provide a surface treating device comprising at least a tubular blasting case having a main opening portion, of which a surface on the side facing the surface of an object is opened, and a sub-opening portion, of which a surface on the side opposite to the side facing the surface of the object is opened; an annular suction-adhering seal which is mounted at the main opening portion of the blasting case to seal a space between the blasting case and the surface of the object; a nozzle for ejecting a surface treating material toward the surface of the object in the sub-opening portion; a parallel moving mechanism which allows the nozzle to reciprocate along, and in parallel with, the surface of the object; a flat belt for covering the sub-opening portion to which the nozzle is mounted; a pressure reduction means which is connected to a space defined by the surface of the object, the blasting case, the suction-adhering seal and the flat belt and reduces a pressure in the space. To overcome the above other technical problems, an object of the present invention is to provide a surface treating device in which a moving means such as running wheels is provided to the blasting case and which is adapted to suction-adhere to the surface of the object by the pressure of an ambient fluid acting on the blasting case owing to the difference in fluid pressure between the inside and outside of the blasting case and to move along the surface of the object by the action of the moving means.

In the means to overcome the above main technical problems, the nozzle is reciprocated in parallel with the surface of the object in the sub-opening portion by a parallel moving mechanism, and since the nozzle is fitted to the flat belt which covers the sub-opening portion, a space surrounded by the surface of the object, the blasting case, the suction-adhering seal and the flat belt is depressurized by being connected to a pressure reduction means via a suction air hose or the like.

Therefore, a swivel joint is not needed in the present invention because the nozzle does not rotate when it reciprocates in the direction parallel with the surface of the object.

There is generally employed a method wherein, in conventional ultrahigh pressure water jetting equipment, a mixing nozzle in which abrasives are mixed into ultrahigh pressure water on the downstream side of the nozzle is provided as a means for mixing the abrasives into an ultrahigh pressure water stream because it is difficult to mix abrasives having a larger size than the diameter of the nozzle into the ultrahigh pressure water stream prior to ejecting the abrasives from the nozzle for the reason that the diameter of the orifice of the nozzle is too small for ejecting of the abrasives.

In the device of the present invention mentioned above, there is no problem in providing of a mixing nozzle for mixing ultrahigh pressure water with abrasives on the downstream side of the nozzle when the nozzle undergoes reciprocating motion.

In the case where the device of the present invention is also applicable to a sand blasting type surface treating device, abrasives can be ejected from the nozzle after being mixed into a compressed air stream because the diameter of the orifice of the nozzle for the sand blasting is 8 to 15 mm, which is much larger than the abrasives.

Next, in the means to overcome other technical problems mentioned above, when the pressure reduction means is energized, a fluid such as the air inside the pressure reduction space is discharged to the outside of the pressure reduction space whereby the pressure reduction space is reduced in pressure as desired. Once the pressure reduction space is so reduced in pressure, the pressure of an ambient fluid such as the air acting on the case owing to the difference in fluid pressure between the inside and the outside of the pressure reduction space is transmitted to the surface of the object via the moving means. Thus, the device is caused to suction-adhere to the surface of the object under this ambient fluid pressure.

BEST MODE FOR CARRYING OUT THE INVENTION

Figure 1:
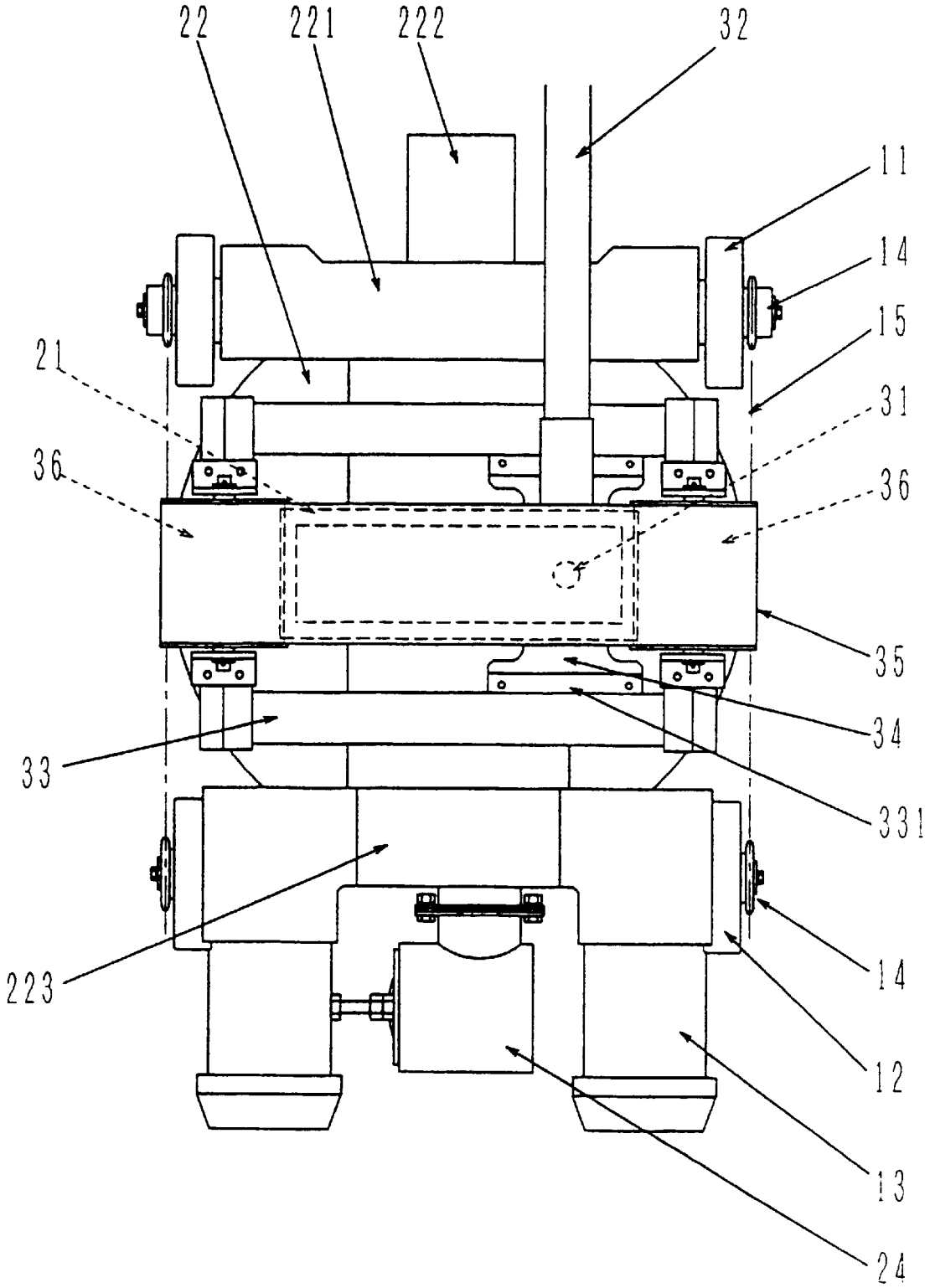
FIG. 1 is a plan view showing a first preferred embodiment of the device constructed in accordance with the present invention.

A preferred embodiment of the device constructed in accordance with the present invention will be described in further detail with reference to the accompanying drawings.

With reference to FIGS. 1 to 5, the illustrated device has a blasting case 21 which has a shape of a box and of which the inside is hollow in structure, and a suction-adhering seal mounting plate 22 is welded to an opening portion, which faces the surface of the object, of the blasting case 21 and a suction-adhering seal 23 is fixed to the suction-adhering seal mounting plate 22.

A sub-opening portion 211 is formed at the counter side, which is opposite to the surface of the object, of the opening portion of the blasting case 21, and has a nozzle 31 which is bent at an angle of 90 degrees and ejects a surface treating material(s) toward a surface 01 of the object.

At the sub-opening portion 211 is mounted a parallel moving means comprising two rod-less air cylinders 33 which reciprocatingly moves the nozzle 31 along, in parallel, the surface 01 of the object and a reciprocating plate 34 which connects sliding bars 331 of the two rod-less air cylinders 33, and the nozzle 31 is fitted to the reciprocating plate 34.

Further, the sub-opening portion 211 is provided with an endless flat belt 35 that covers the sub-opening portion. The endless flat belt 35 is suspended by two follower pulleys and has the nozzle 31 on the surface of that side thereof which covers the sub-opening portion.

Therefore, the suction-adhering seal mounting plate 22 may be regarded as a part of the blasting case 21.

Figure 5:
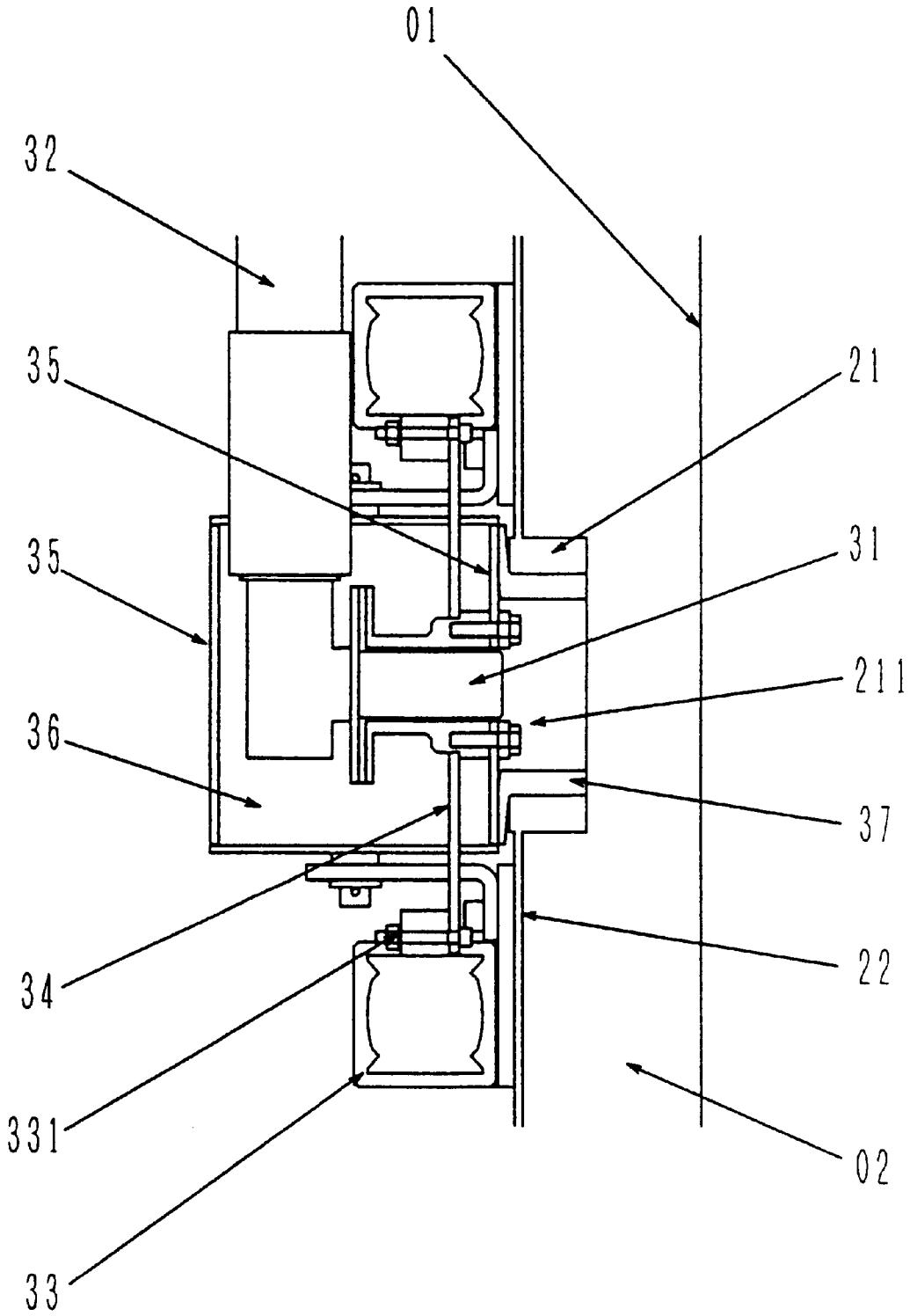
FIG. 5 is a partially enlarged sectional view taken on line A—A showing an embodiment of the device in which a sub-opening portion seal is added in the device of FIG. 1.

Further, as illustrated in FIG. 5, the opening portion 211 may have, on the whole periphery thereof, an annular sub-opening portion seal 37 that contacts with the surface on the side, which faces the sub-opening portion, of the endless flat belt 35, and the sub-opening portion seal 37 has a annular lip portion attached to the endless flat belt which extends outwardly viewed from the center portion of the sub-opening portion, as it approaches the utmost end portion of the lip portion.

Figure 2:
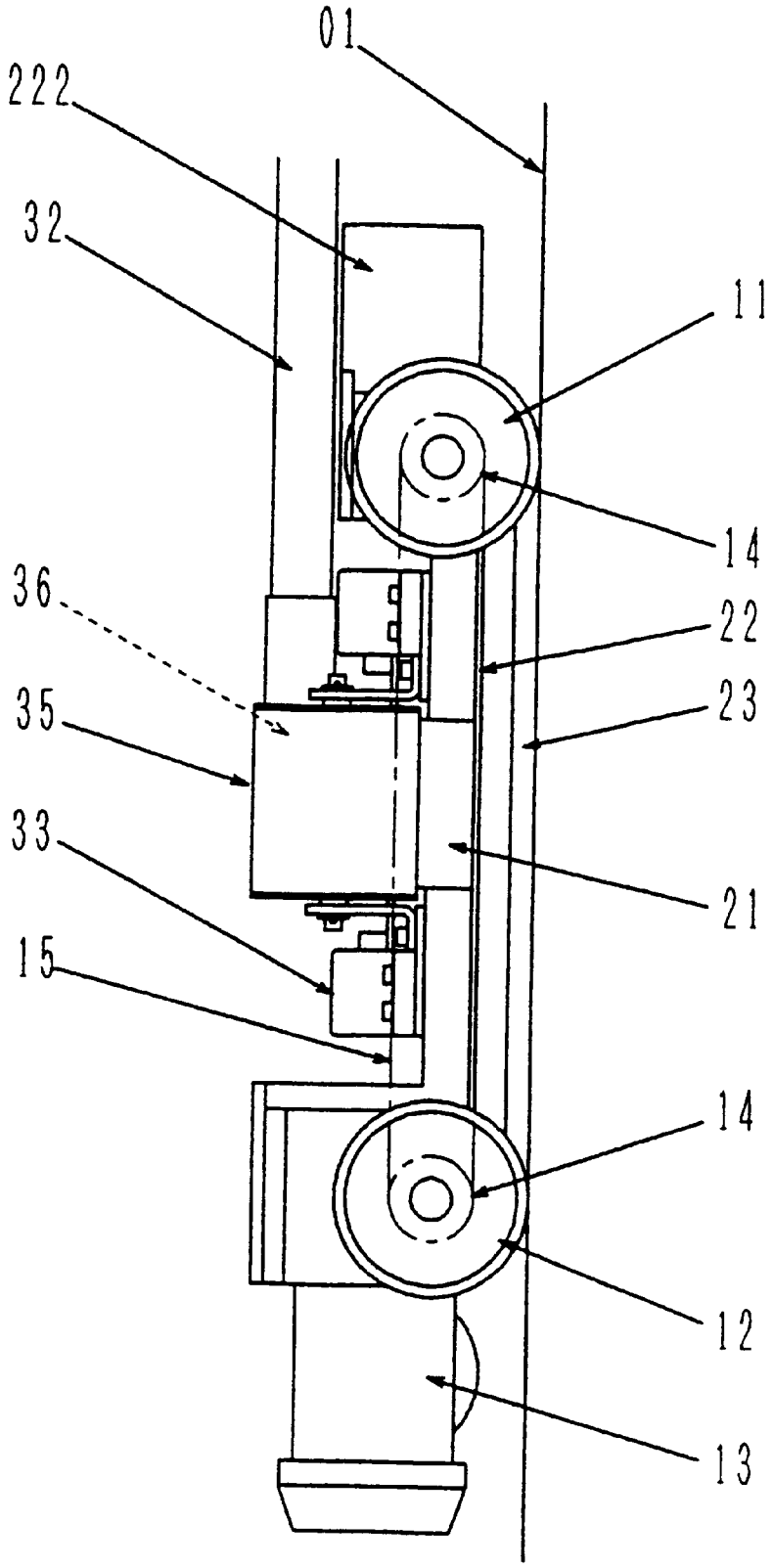
FIG. 2 is a right side view of the device shown in FIG. 1.
Figure 3:
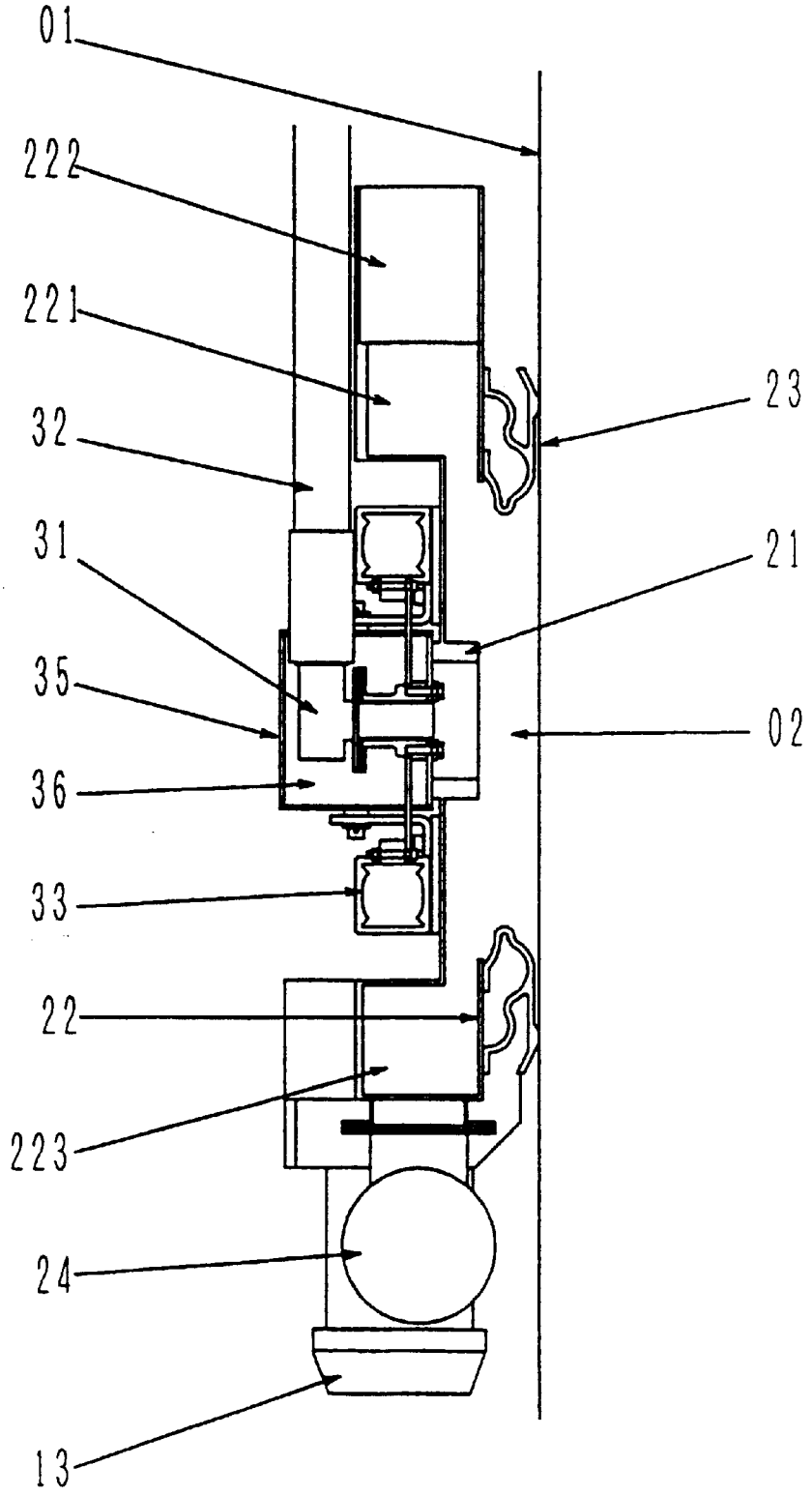
FIG. 3 is a sectional view taken on line A—A in the device shown in FIG. 1.
Figure 4:
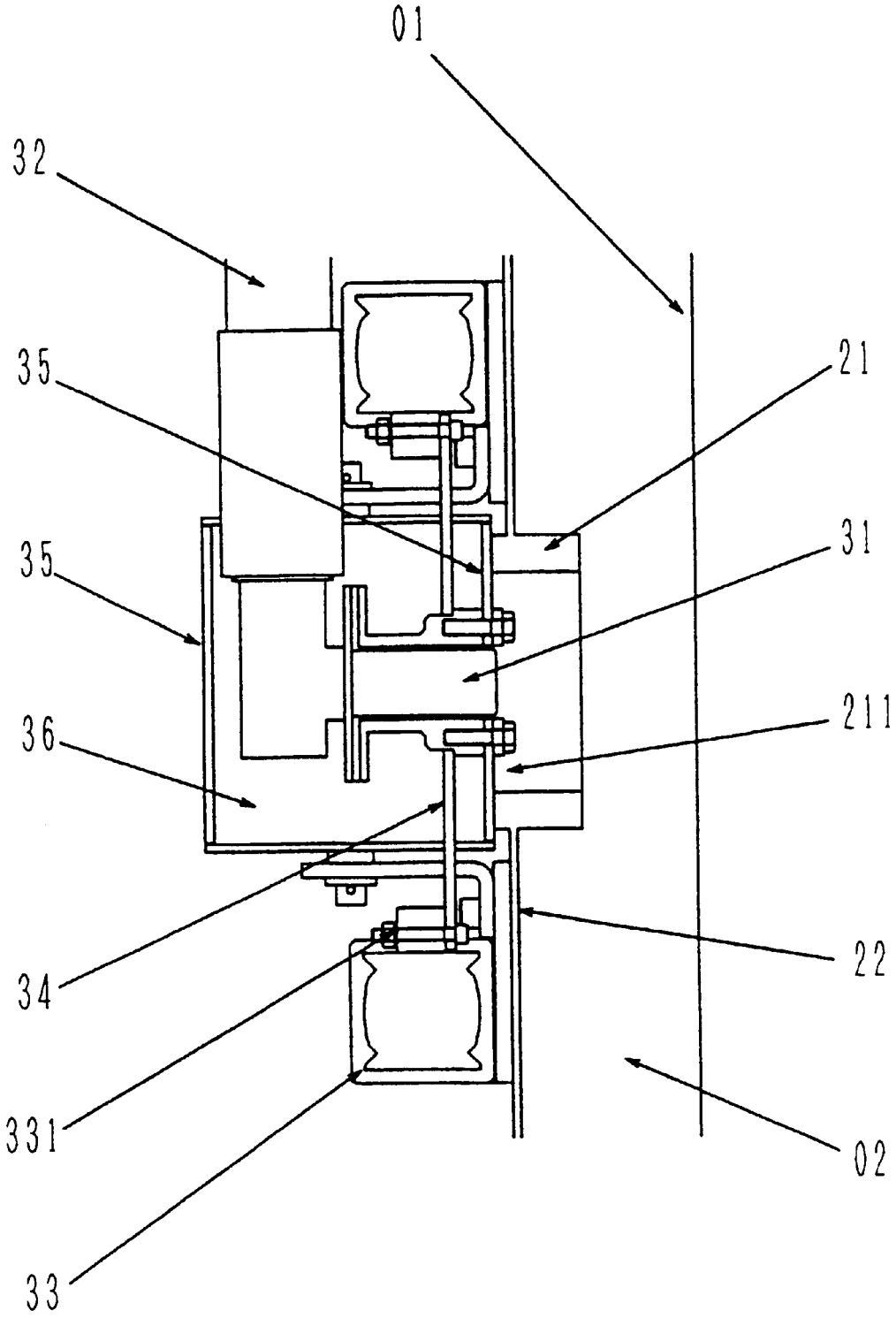
FIG. 4 is a partially enlarged sectional view taken on line A—A in the device shown in FIG. 1.

The suction-adhering seal 23 is formed from, for example, a relatively flexible material such as urethane rubber, plastics or the like and as will be understood from FIGS. 2 and 3, its shape is of a nearly circular form as a whole. The suction-adhering seal 23 defines a pressure reduction space 02 in cooperation with the object surface 01, the blasting case 21, the suction-adhering seal mounting plate 22 and the endless flat belt 35 or in cooperation with the sub-opening portion seal 37 in addition to the above.

An upper housing 221 is provided at the upper portion of the suction-adhering seal mounting plate 22 and a suction hose connecting pipe 222 welded to the upper housing 221 is connected to a pressure reduction means (not shown) such as a vacuum pump via a suction hose (not shown).

Therefore, when the pressure reduction means (not shown) is energized, a fluid such as the air inside the pressure reduction space 02 is discharged to the outside through the suction hose (not shown) and thus the pressure reduction space 02 is reduced in pressure as desired.

The suction-adhering seal mounting plates 22 has a lower housing 223 at a lower portion thereof, and the lower housing 223 is equipped with a pressure reduction regulating means such as vacuum breaker 24.

On each side of the left side and the right side of the lower housing 223 is mounted a geared motor 13, of which an output rotating shaft is fitted with a driving wheel 12. Further, on each side of the left side and the right side of the upper housing 221 are mounted a follower wheel 11, and between the driving and follower wheels on both left and right sides, sprockets 14 and a roller chain 15 are provided.

Next, the action of the above-described device will be explained briefly.

When the pressure reduction means (not shown) is energized, a fluid such as the air inside the pressure reduction space 02 is discharged to the outside through the suction hose (not shown), and as a result, the pressure reduction space 02 is reduced in pressure as desired.

Once the pressure reduction space 02 is thus reduced in pressure, the pressure of an ambient fluid such as the air, acting on the blasting case 21, owing to the difference in fluid pressure between the inside and outside of the pressure reduction space 02, is transmitted to the object surface 01 via the wheels 11 and 12. In this manner, the device of the present invention is caused to suction-adhere to the object surface 01 by the pressure of the ambient fluid.

In the sub-opening portion 211 is mounted the nozzle 31 which is bent at an angle of 90 degrees and ejects a treating material toward the surface 01 of the object, and the nozzle repeats a continuous reciprocating motion by an action of the parallel moving mechanism.

As described above, the endless flat belt 35 suspended to the two follower pulleys is fitted to the nozzle 31 and also repeats a reciprocating motion continuously with the continuous reciprocating motion of the nozzle 31. At this time, that surface of the endless flat belt which faces the sub-opening portion 211 is brought into contact with the edge surface of the sub-opening portion 211 owing to the difference in fluid pressure between the inside and outside of the pressure reduction space 02 to cover the whole of the sub-opening portion, and the continuous reciprocating motion is repeated while the sub-opening portion is maintained in a covered condition by the contact.

When the whole periphery of the opening portion of the sub-opening portion 211 is provided with the sub-opening portion seal 37, the annular lip portion comes into contact with the surface, which faces the sub-opening portion, of the endless flat belt, and this makes it possible to further improve the sealing effect compared with the case where the sub-opening portion seal is not provided.

The above description of the preferred embodiments of the device in the present invention may be used on surfaces present in the air, but it is also feasible that the device of the invention is also usable in water. When the device is used in water, a water pump and a water-driving ejector can be employed for the pressure reduction means.

The present invention has been described in detail with reference to the embodiments, but is not limited to these embodiments. Various modifications or changes may be made within the scope of the claims in the present invention. For example, the endless flat belt 35 described in the above embodiments has a shape of the flat belt in at least the portions contacting with the opening portion of the sub-opening portion 211 or the annular lip portion of the sub-opening portion seal 37, the other portion of the belt 35, however, may have holes.

Further, it is possible to use a flat belt or a flat plate in place of the endless belt suspended to the pulleys when a stroke of the reciprocating motion of the nozzle is short.

Since the present invention is constituted as described above, the following effects are achieved.

In an abrasives air-blasting device using compressed air or in an ultrahigh pressure water jetting device, treatment can be effectively made without causing unevenness in treatment on the surface of the object by moving a nozzle which ejects a highly pressured fluid or a highly pressured fluid containing abrasives along, and in parallel with, the object surface.

Similarly, by parallel movement of the nozzle along the surface of the object, it is possible to reduce the height of the device and hence, the device can be used in a narrow space.

In a surface treating device capable of being suction-adhered to the surface of an object such as an oil storage tank or ship hull owing to the pressure of the ambient fluid such as air or water and moving therealong, there is provided a surface treating device in which old coatings or abrasive grains peeled off from the object surface are prevented from scattering to the outside of the device to not contaminate the environment and which is safe because it can be operated by a remote-control mode.

The device of the invention enables mixing of abrasives into an ultrahigh pressure fluid that is ejected from the nozzle which reciprocates inside the pressure-reduced space without using a swivel joint as a means of supplying a highly pressured fluid or a highly pressured fluid containing abrasives to the nozzle.

Since the abrasives can be mixed into the ultrahigh pressure water stream ejected from the nozzle, the device of the invention enables one to peel off not only soft coatings but also hard rusts and to form an anchor pattern, i.e., roughness, on the surface of an object.

I claim:

1. A surface treating device, comprising:

a blasting case having a main open face facing a surface of an object to be treated and a sub-open face opposite the main open face, the blasting case having a blasting case opening defined between the main open face and the sub-open face;

a suction-adhering seal engaged with the blasting case to seal a space defined between the blasting case and the surface of the object to be treated;

a nozzle mounted for ejecting a surface treating material through the blasting case opening toward the surface of the object while reciprocatingly moving in parallel with the surface of the object;

moving means for moving the nozzle reciprocatingly along, and in parallel with, the surface of the object;

a flat belt member having a nozzle opening defined therethrough and being at least partially engaged with the sub-open face of the blasting case, the flat belt member being positioned to cover the blasting case opening, the nozzle being received in the nozzle opening of the flat belt member;

a pressure reduction space defined by the surface of the object, the blasting case, the suction-adhering seal, and the flat belt member; and pressure reducing means for reducing a pressure in the pressure reduction space, wherein a surface of the flat belt member which faces the sub-open face is brought into sealing contact with a surface of the sub-open face due to a difference in pressure between an inside and an outside of the pressure reduction space caused by the pressure reducing means reducing the pressure in the pressure reduction space;

wherein the flat belt member together with the nozzle repeats a continuous reciprocating motion under the influence of the moving means while the flat belt member remains in sealing contact with the surface of the sub-open face; and wherein the flat belt member is positioned such that the blasting case opening is completely covered and sealed while the flat belt member is moving.

2. The surface treating device of claim 1, further comprising:

a sub-open face seal disposed in between and to enhance sealing contact of the sub-open face and the flat belt member, the sub-open face seal having a lip portion which extends from the sub-open face into, and against a surface defining the blasting case opening.

3. The surface treating device of claim 1, wherein:

the flat belt member comprises an endless flat belt which is movably suspended by two pulleys.

4. The surface treating device of claim 1 further comprising:

moving means for moving the device, the moving means including wheels, wherein the device is adapted to suction-adhere to the surface of the object by the pressure of an ambient fluid acting on the blasting case owing to the difference in fluid pressure between the inside and outside of the blasting case, and wherein the device moves along the surface of the object by the action of the moving means for moving the device.

5. The surface treating device of claim 1, wherein:

the moving means for moving the nozzle includes two rod-less cylinders and a reciprocating plate, wherein the reciprocating plate is connected with sliding members of the two rod-less cylinders and the nozzle is engaged with the reciprocating plate.

6. The surface treating device of claim 1, wherein:

the blasting case further includes a mounting plate member, the mounting plate member forming an outwardly extending portion of the blasting case, the suction-adhering seal being engaged with the mounting plate member.

7. A surface treating device, comprising:

a blasting case having a main open face facing a surface of an object to be treated and a sub-open face opposite the main open face, the blasting case having a blasting case opening defined between the main open face and the sub-open face;

a suction-adhering seal engaged with the blasting case to seal a space defined between the blasting case and the surface of the object to be treated;

a nozzle mounted for ejecting a surface treating material through the blasting case opening toward the surface of the object while reciprocatingly moving in parallel with the surface of the object;

moving means for moving the nozzle reciprocatingly along, and in parallel with, the surface of the object;

a flat plate member having a nozzle opening defined therethrough and being at least partially engaged with the sub-open face of the blasting case, the flat plate member being positioned to cover the blasting case opening, the nozzle being received in the nozzle opening of the flat plate member;

a pressure reduction space defined by the surface of the object, the blasting case, the suction-adhering seal, and the flat plate member; and pressure reducing means for reducing a pressure in the pressure reduction space, wherein a surface of the flat plate member which faces the sub-open face is brought into sealing contact with a surface of the sub-open face due to a difference in pressure between an inside and an outside of the pressure reduction space caused by the pressure reducing means reducing the pressure in the pressure reduction space;

wherein the flat plate member together with the nozzle repeats a continuous reciprocating motion under the influence of the moving means while the flat plate member remains in sealing contact with the surface of the sub-open face; and wherein the flat plate member is positioned such that the blasting case opening is completely covered and sealed while the flat plate member is moving.

8. The surface treating device of claim 7, wherein:

the blasting case further includes a mounting plate member, the mounting plate member forming an outwardly extending portion of the blasting case, the suction-adhering seal being engaged with the mounting plate member.

9. A surface treating device, comprising:

a blasting case having a main open face facing a surface of an object to be treated and a sub-open face opposite the main open face, the blasting case having a blasting case opening defined between the main open face and the sub-open face;

a suction-adhering seal engaged with the blasting case to seal a space defined between the blasting case and the surface of the object to be treated;

a nozzle mounted for ejecting a surface treating material through the blasting case opening toward the surface of the object while reciprocatingly moving in parallel with the surface of the object, wherein the nozzle includes a bend having a 90 degree angle;

moving means for moving the nozzle reciprocatingly along, and in parallel with, the surface of the object, the moving means including two rod-less cylinders and a reciprocating plate, wherein the reciprocating plate is connected with sliding members of the two rod-less cylinders and the nozzle is engaged with the reciprocating plate;

a flat belt member having a nozzle opening defined therethrough and being at least partially engaged with the sub-open face of the blasting case, the flat belt member including an endless flat belt having two portions movably extending between two pulleys spaced apart from one another, one of the two portions covering the blasting case opening and defining a nozzle opening, the nozzle being received in the nozzle opening of the flat belt member and in a space defined between the two portions of the flat belt member;

a pressure reduction space defined by the surface of the object, the blasting case, the suction-adhering seal, and the flat belt member; and pressure reducing means for reducing a pressure in the pressure reduction space, wherein a surface of the flat belt member which faces the sub-open face is brought into sealing contact with a surface of the sub-open face due to a difference in pressure between an inside and an outside of the pressure reduction space caused by the pressure reducing means reducing the pressure in the pressure reduction space;

wherein the flat belt member together with the nozzle repeats a continuous reciprocating motion under the influence of the moving means while the flat belt member remains in sealing contact with the surface of the sub-open face; and wherein the flat belt member is positioned such that the blasting case opening is completely covered and sealed while the flat belt member is moving.

* * * * *